US006178750B1

(12) United States Patent
van der Werff et al.

(10) Patent No.: US 6,178,750 B1
(45) Date of Patent: Jan. 30, 2001

(54) METHOD AND APPARATUS FOR CONVERTING THERMAL ENERGY INTO WORK

(75) Inventors: Jeichienus Adriaan van der Werff, Montfoot; Johannes Jeichienus van der Werff, Delfgauw, both of (NL)

(73) Assignee: Cyclo Dynamics B.V., Montfoort (NL)

( * ) Notice: Under 35 U.S.C. 154(b), the term of this patent shall be extended for 0 days.

(21) Appl. No.: 09/341,404

(22) PCT Filed: Jan. 8, 1998

(86) PCT No.: PCT/NL98/00012

§ 371 Date: Nov. 15, 1999

§ 102(e) Date: Nov. 15, 1999

(87) PCT Pub. No.: WO98/30786

PCT Pub. Date: Jul. 16, 1998

(30) Foreign Application Priority Data

Jan. 8, 1997 (NL) ..... 1004950

(51) Int. Cl.[7] ..... F01K 25/02
(52) U.S. Cl. ..... 60/650; 60/682
(58) Field of Search ..... 60/650, 682

(56) References Cited

U.S. PATENT DOCUMENTS 4,183,220 * 1/1980 Shaw ..... 60/650 X
4,222,239 9/1980 Negishi ..... 60/527
4,283,915 * 8/1981 McConnell et al. ..... 60/650
4,637,211 1/1987 White et al. ..... 60/650
5,321,946 * 6/1994 Abdelmalek ..... 60/650 X

FOREIGN PATENT DOCUMENTS 33 05 253 A1 2/1983 (DE) .
89 14 171 U 1/1989 (DE) .
7117983 7/1972 (NL) .

* cited by examiner

*Primary Examiner*—Hoang Nguyen
(74) *Attorney, Agent, or Firm*—Kinney & Lange, P.A.

(57) ABSTRACT

The invention relates to a method and an apparatus for the conversion of low-grade heat into mechanical energy, in particular electricity. To this end a working medium is heated in a closed circulation system causing the working medium to expand. The expansion produces mechanical energy. The heat remaining in the working medium is abstracted by a cooling medium in counterflow, to be reutilized for the production of mechanical energy. This makes its possible to achieve a high degree of efficiently. Due to cooling the working medium contracts and this contributes to the achievement of a high degree of efficiency. The working medium is preferably a paraffine.

13 Claims, 5 Drawing Sheets

METHOD AND APPARATUS FOR CONVERTING THERMAL ENERGY INTO WORK

Figure 1:
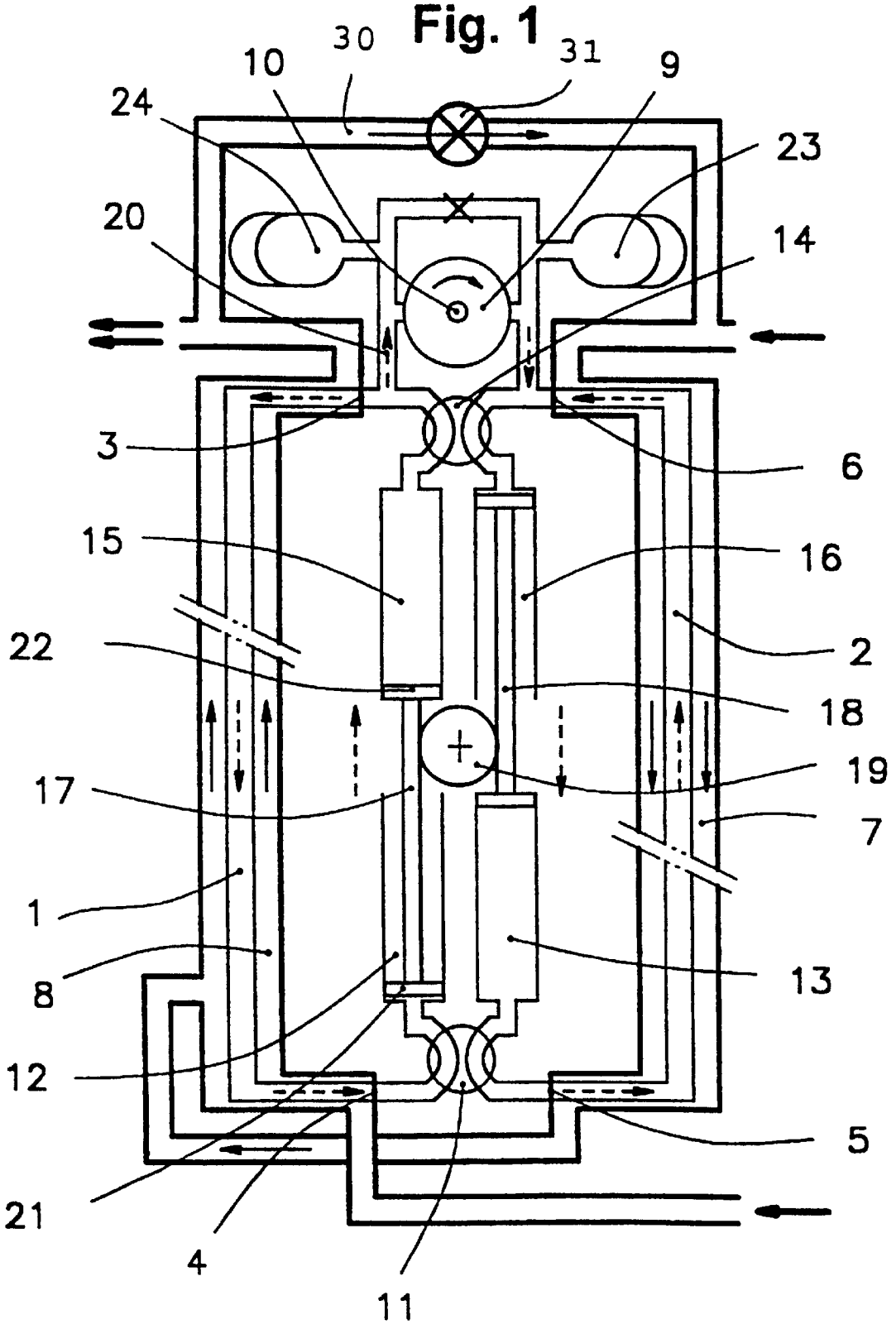

Malone has described a method (Journal of The Royal Society of Arts, Jun. 12, 1931, pp. 679–703) wherein heat is abstracted from a heated working medium for its further utilization in the production of mechanical energy. To this end Malone employs an apparatus (also described in the thermodynamics atlas, Longman Group Ltd., pp 78 and 90, 1972) comprising a first and a second vertical elongated chamber, which chambers are continuously heated at the base. The apparatus, and consequently also each chamber, is filled with water as the working medium, which expands in the chambers as a result of heating. The first vertical chamber is in communication with a first drive chamber, the second vertical chamber communicates with a second drive chamber. The first and second drive chambers are placed in each other'extensions and at their facing sides they are sealed by means of a movable double piston. When the double piston is in a first extreme position, the first drive chamber's volume is at a maximum, while that of the second drive chamber is at a minimum, and vice versa. Through the expansion of the working medium in the first vertical chamber the first drive chamber is being filled, thereby moving the double piston. This drives a crankshaft which transmits the mechanical energy produced. Moving the rod-like elements in vertical direction does not alter the volume available for the working medium in an elongated chamber. When the one elongated element is in the highest position, the other elongated element is in the lowest position. Further, an elongated element is 90° out-of-phase in relation to the position of the double piston. When the working medium in the elongated chamber expands, it moves upward along the elongated element, filling the drive chamber with which the elongated chamber is in communication. The crankshaft rotates the elongated element to a lower position. This results in there being less working medium in the heated part of the elongated chamber and the working medium cooling off in the higher part of the elongated chamber. Due to cooling, the working medium contracts and the drive chamber which is in communication with the elongated chamber, empties. This, too, contributes to the driving of the double piston. The other elongated chamber is 180° out-of-phase, filling at the same moment the other drive chamber, which drives the crankshaft. Between the part of the elongated chamber that is being heated and the part that is being cooled, a heat exchanger is provided. When the hot working medium rises it gives out heat to the heat exchanger. When the working medium drops, it reabsorbs this heat. Therefore, when the apparatus is in operation, the lower part of the heat exchanger is hot, while the upper part is cold. The advantage of this kind of heat exchange is that there is little heat loss to the cooling medium, with the result that the conversion of heat into mechanical energy is highly efficient. Malone used water as working medium, while the apparatus operated at a working-medium pressure of approximately 700 atm. At a hot/cold temperature difference of 250° C. his apparatuses yielded an output of 23 percent.

The disadvantage of this method is that the working medium in the expansion and working phase has to pass a cold heat exchanger to which it gives out heat. This means that during the production of mechanical energy, the working medium contracts, and this reduces efficiency. Conversely, during its mechanical energy-producing contraction phase, the working medium absorbs heat causing it to expand, so that in this phase of the method, too, efficiency is reduced. Admittedly, little energy is lost, but the transport of heat to and fro is not useful. The rod-like elements also have a heat exchanging effect. As they move in relation to the heat exchanger, their temperature at a particular height does not correspond with that of the heat exchanger. This limits the efficiency of heat recovery. For a particular output power to be supplied to the (crank)shaft, the apparatus is large and demands a heavy construction.

The present invention allows the heat exchanger to be maintained, at least substantially, at the same temperature and avoids that the working medium undergoes a heat exchange which would counteract the production of mechanical energy.

According to a favourable embodiment the liquid is conducted into the second part in counter current to a cooling medium, yielding heated cooling medium, and the heat of the thus heated cooling medium is conducted in counter current with the working medium into the first part for the production of mechanical energy.

By using such a method it is possible to employ heat exchangers of a simple and consequently cheap construction.

According to a preferred embodiment of the method according to the invention the liquid used is a liquid whose expansion coefficient in a working range is at least 0.02%/°C., preferably at least 0.05%/°C. and most preferably at least 0.7%/°C.

A liquid with a high expansion coefficient promotes the effective conversion of heat into mechanical energy, in particular the generation of electrical energy.

Preferably, the working range lies between 15° C. and 100° C.

Thanks to its high efficiency, the method according to the invention is very suitable for using heat sources of a relatively low temperature.

In such a case the liquid used is preferably a paraffine-comprising liquid.

Paraffine-comprising liquids such as paraffine and paraffinic solutions in, for example, hydrocarbonic solvents, exhibit a remarkably high expansion coefficient at relatively low temperatures, which makes them very suitable for the production of mechanical energy by means of the method according to the invention.

In order to reduce in a suitable apparatus the energy losses incurred by internal resistance, a liquid is employed as the paraffine-containing liquid, which comprises an additive capable of lowering the internal resistance.

For the convenient reduction of flow resistance a substance such as Petrolad (B.R.B., Ittervoort, the Netherlands) is added, for example, in a ratio of 1:10,000. To reduce the friction between moving parts, for example 1–4% of a molecular lubricant, teflon or molybdenum sulphide may be added, the latter two to be dispersed in the working medium in the form of granules with an average size of, for instance, 3 $\mu$m.

If one wishes to employ for the production of energy some available heat source, the working range may very advantageously be adapted by using as the paraffin-comprising liquid a paraffinic liquid having a working range that has been shifted to a lower temperature through dilution.

In another embodiment according to the invention the working medium, in the part to be heated, is heated in counter current with a heat source.

In this manner the thermal energy present in the heat source is optimally utilized.

The invention also relates to an apparatus suitable for the conversion of thermal energy into mechanical energy according to a method in accordance with one of the claims 1 to 9, which apparatus comprises a part to be heated and a part to be cooled, which parts form a closed circulation system for the working medium, wherein during operation the working medium is able to flow from the part to be heated to the part to be cooled, and the apparatus is further provided with a shaft to be driven by the working medium and a heat exchanger for the recovery of thermal energy that has not been converted into mechanical energy, wherein the part to be heated has a first inlet opening for cold working medium and a first outlet opening for heated working medium, the part to be cooled has a second inlet opening for heated working medium and a second outlet opening for cold working medium, via a first switch valve in a first position the first outlet opening is in communication with a first storage chamber for heated working medium and in a second position with a second storage chamber for heated working medium, and the second inlet opening is in the second position in communication with the first storage chamber for heated working medium and in the first position with the second storage chamber for heated working medium, via a second switch valve in a first position the first inlet opening is in communication with a first storage chamber for cold working medium and in a second position with a second storage chamber for cold working medium and the second outlet opening is in the second position in communication with the first storage chamber for cold working medium and in the first position with the second storage chamber for cold working medium, the first storage chamber for heated working medium is effectively in communication with a first storage chamber for cold working medium such than when during operation the first storage chamber for heated working medium is filled to a maximum, the first storage chamber for cold working medium will be filled to a minimum, and vice versa, the second storage chamber for heated working medium is effectively in communication with a second storage chamber for cold working medium such than when during operation the second storage chamber for heated working medium is filled to a maximum, the second storage chamber for cold working medium will be filled to a minimum, and vice versa, during operation the first storage chamber for heated working medium is filled to a maximum when during operation the second storage chamber for heated working medium is filled to a minimum, and means are provided for taking a stage in which the first storage chamber for heated working medium and the second storage chamber for cold working medium are filled to a maximum, to a stage in which these are filled to a minimum and vice versa, the part to be heated is in communication with the part to be cooled via a device which is driven by means of the flow of the working medium, which device comprises the shaft.

White et al. (U.S. Pat. No. 4,637,211) disclose a somewhat similar apparatus differing from the apparatus according to the present invention in that, among other things, expanded working medium flows to accumulators which act as a pump to force a hydraulic fluid therefrom to drive a hydraulic motor which produces mechanical energy. In contrast and in accordance with the present invention, expanding working medium drives a shaft.

This apparatus creates a substantially constant flow of working medium through the device to be driven, while, in contrast with the apparatus of Malone, the working medium in the device moves in one direction only.

According to a favourable embodiment the first storage chamber for warm working medium and the first storage chamber for cold working medium, respectively the second storage chamber for warm working medium and the second storage chamber for cold working medium are provided with pistons.

This provides a practical way of adapting the volume of the storage chambers.

According to a preferred embodiment the apparatus according to the invention is characterized in that it is provided with means for keeping a side of the piston that is not facing the storage chamber under elevated pressure while the apparatus is in operation, which means are preferably suitable for maintaining a pressure which is equally high as the pressure prevailing in the part, and the means are thermically insulating means.

This allows friction in the apparatus to be reduced and the efficiency to be increased.

Figure 2:
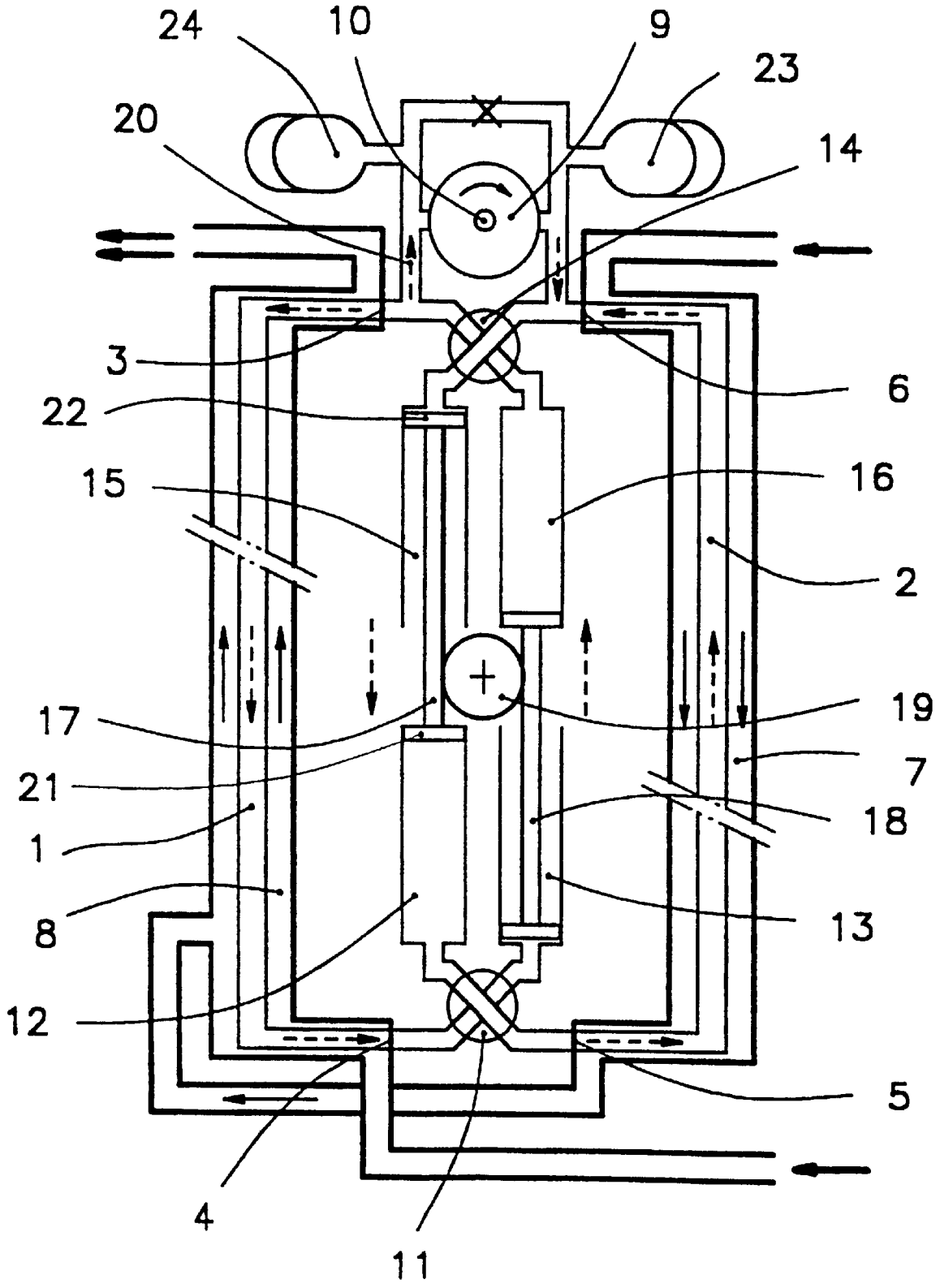
Figure 3A:
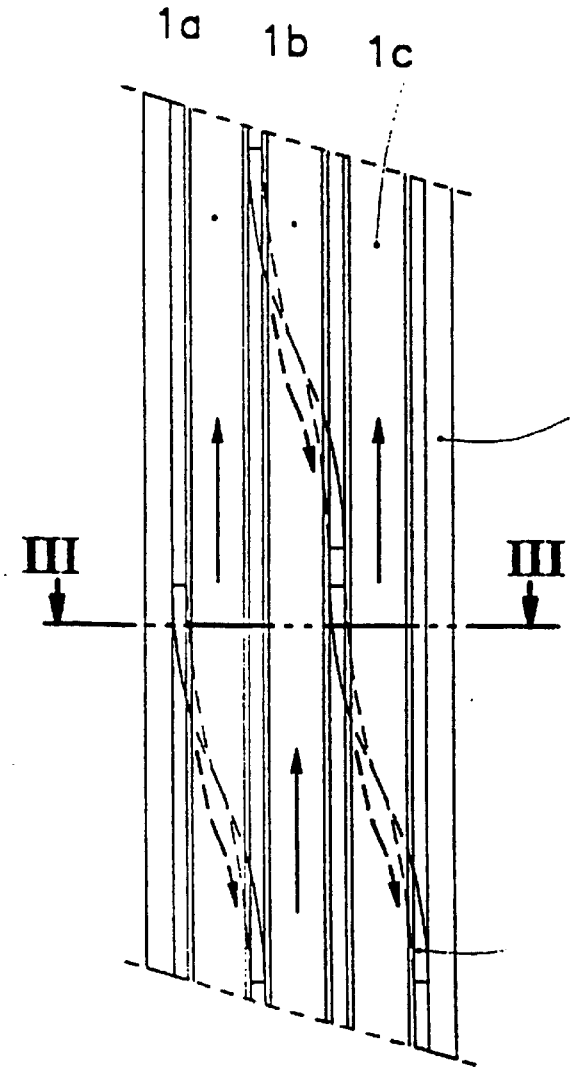
Figure 3B:
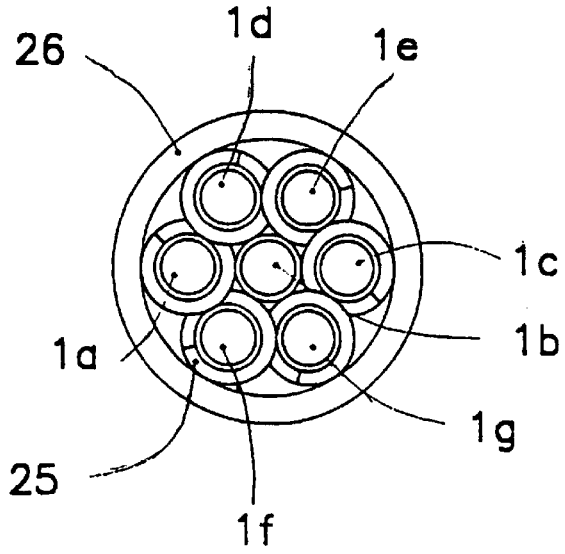
Figure 4:
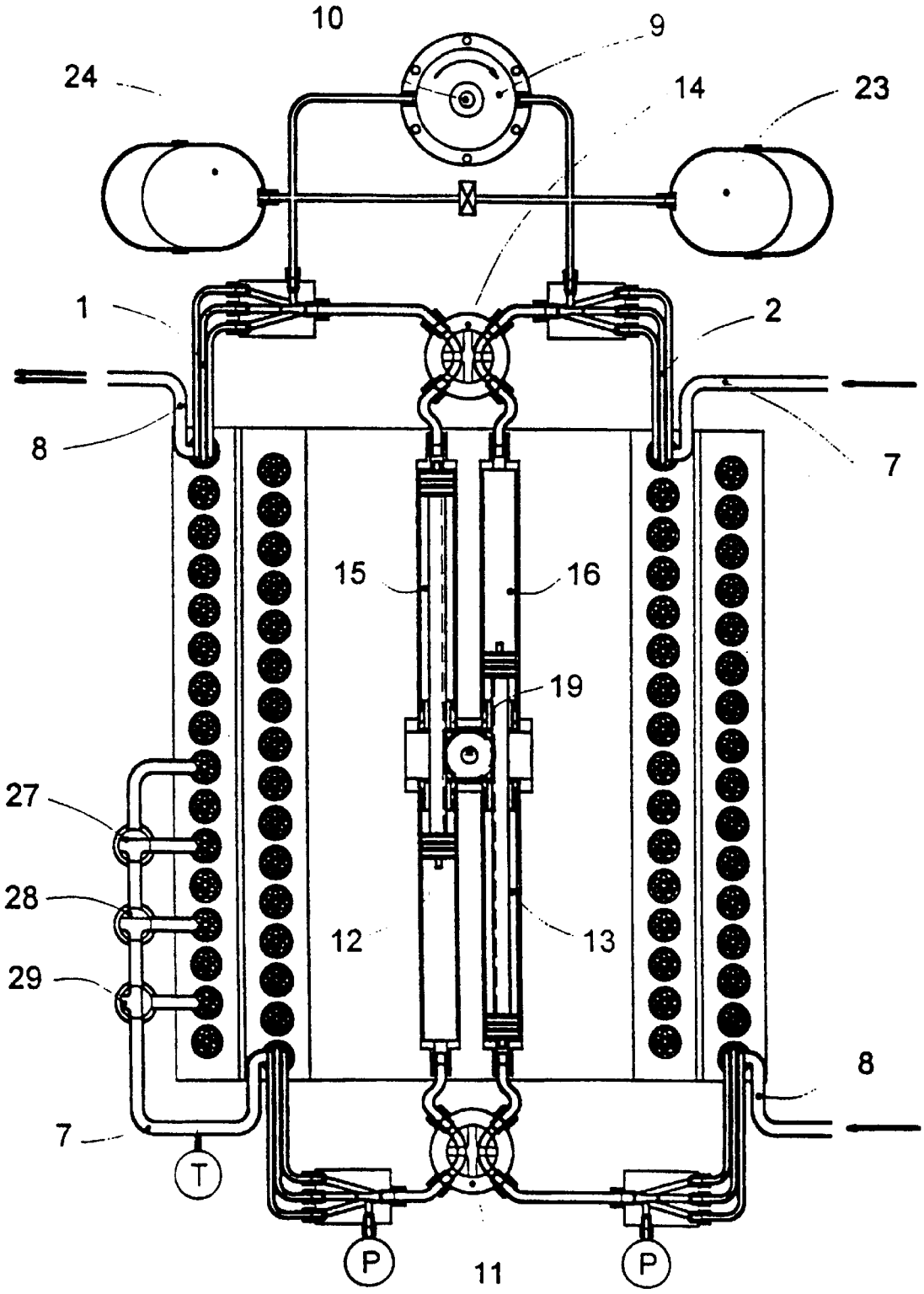
Figure 5:
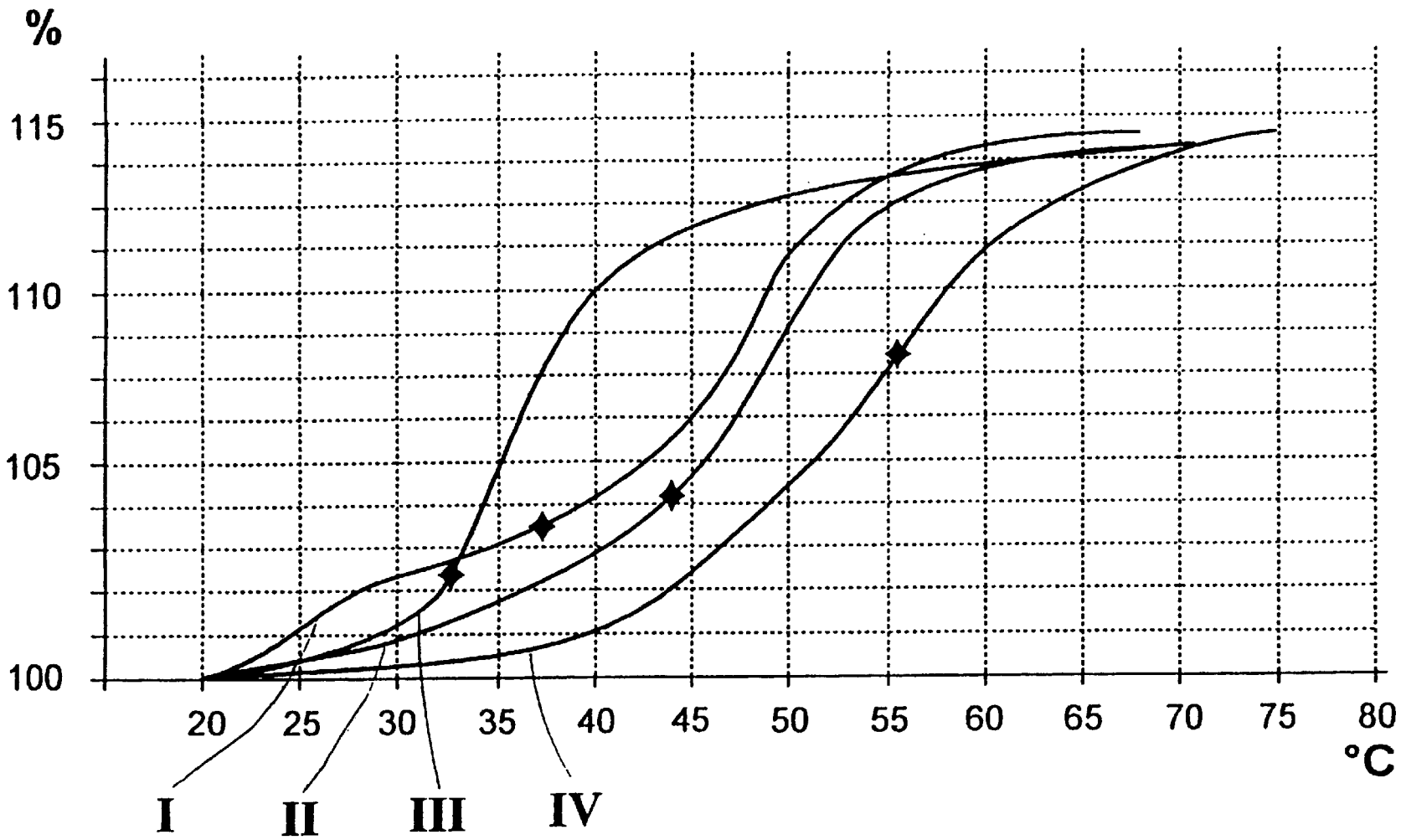

The invention will now be explained by means of the following, non-limitative example of an embodiment with reference to the accompanying drawing, in which FIG. 1 shows a schematic representation of the apparatus according to the invention in a first operational position;

FIG. 2 shows a schematic representation of the apparatus according to the invention as represented in FIG. 1, in a second operational position;

FIG. 3*a* shows a cross section of a part of a heat exchanger suitable for an embodiment of the apparatus according to the invention, and FIG. 3*b* represents a cross section along line III—III;

FIG. 4 represents a detailed cross-sectional side view of an embodiment of the apparatus according to the invention, and FIG. 5 is a graphic representation of the expansion behaviour of a number of paraffines.

The apparatus shown in FIG. 1, for the conversion of thermal energy into mechanical energy, especially into electricity, comprises a part 1 to be heated and a part 2 to be cooled. The part 1 to be heated has an inlet opening 3 and an outlet opening 4, and the part 2 to be cooled has an inlet opening 5 and an outlet opening 6. The outlet opening 4 and the inlet opening 5 are linked in the manner described below, as are the outlet opening 6 and the inlet opening 3, thereby forming a closed system. To operate the closed system, a non-gaseous working medium capable of flowing is used. The term working medium in the present invention is understood to be a liquid, including also suspensions and pastes.

Preferably, the working medium in a working range has the highest possible heat coefficient. As will be explained in more detail hereafter, the working range is understood to be a temperature range, defined at the lower limit by the temperature of a cooling medium and at the upper limit by the temperature of a heat source. As the working medium expands under the influence of heat absorption, a working medium flow is generated, which working medium flow is utilized for the production of mechanical energy. The apparatus may, for instance, be provided with an organ for the conversion of flow energy into rotation energy, such as a hydromotor 9 having a shaft 10. The shaft 10 is preferably connected to a generator (not shown) for the generation of electricity. According to the favourable embodiment shown in FIGS. 1 and 2, the hydromotor 9 is driven by the working medium directly.

In the embodiment shown in FIGS. 1 and 2, the part 2 to be cooled is equipped to be cooled by application of the counter-current principle. In the embodiment shown this is realized by means of a tube 7 which surrounds the part 2 to be cooled. During operation of the apparatus the cooling medium flows through the tube 7 in the direction indicated by an arrow. For the effective heat transfer, and in particular to limit the heated surface area, the cooling medium is preferably a liquid. All, or part of the cooling medium may be reused. For this purpose the apparatus shown in FIG. 1 is provided with a feed-back pipe 30 and pump 31. If all of the cooling medium is fed back, the cooling medium must be cooled via a heat exchanger. If only part of the cooling medium is fed back, the cooling medium must be replenished with further cooling medium whose temperature is such as to sufficiently lower the temperature of the cooling medium.

Advantageously, part 1 to be heated is also heated in counter current. The embodiment shown realizes this advantageously by feeding the cooling medium that was heated by the part 2 that was to be cooled through a tube 8, which tube 8 here surrounds the part 1 to be heated. It should be noted, that this makes it possible to at least virtually utilize the entire heat content of the heat flow supplied to the apparatus.

Apart from mixing the heat flow and the cooling medium, an alternative embodiment (not shown) also offers the possibility of keeping these flows separate. For instance, a first pipe could be used to convey the heat flow, the first pipe would run through a second pipe to convey the working medium to be heated, which second pipe would be surrounded by a third pipe conveying the working medium to be cooled. This latter pipe could be surrounded by a pipe containing cooling liquid.

Preferably the cooling liquid absorbs as much heat as possible from the working medium in the part 2 to be cooled. This allows thermal energy not converted into mechanical energy to be recovered in order to still be converted into mechanical energy.

The thermal energy converted into mechanical energy has to be replenished, this is done by means of a heat source. This heat source may be any heat source such as heat generated by combustion of organic matter, such as biogas, oil, wood, coal, etc., nuclear energy, solar energy, residual heat from the process industry or from total energy plants, terrestrial heat, etc.

The heat is preferably supplied in the form of a liquid medium, again to limit the heat surface area.

In the embodiment shown the medium is a heat source, such as warm process water to be discharged, which heat source is also supplied to the pipe 8 and which, together with the cooled cooling medium, is carried away. As it is not possible to completely recover all the heat from the part 2 to be cooled, and as of course a part of the heat is converted into mechanical energy, the temperature of the heated cooling medium will be definition be lower than that of the heat source. In the illustrated embodiment of the apparatus according to the invention, this has been taken into account by introducing the heated cooling medium into the pipe 8 at a point downstream from the point where the heat source is introduced.

In the embodiment shown, via a first switch valve 11 in a first position the outlet opening 4 of the part 1 to be heated is in communication with a first storage chamber 12 for heated working medium. In said first position of the first switch valve 11 the inlet opening 5 of the part 2 to be cooled is in communication with a second storage chamber 13 for heated working medium.

Similarly, via a second switch valve 14 in a first position, the outlet opening 6 of the part 2 to be cooled is in communication with a first storage chamber 16 for cooled working medium. In said first position of the second switch valve 14 the inlet opening 3 of the part 1 to be heated is in communication with a second storage chamber 15 for cooled working medium. In view of the high pressures occurring during operation of the apparatus, the storage chambers 12, 13, 15, 16 are conveniently cylindrical.

The first storage chamber 12 for heated working medium is effectively in communication with a first storage chamber 15 for cooled working medium. Similarly, the second storage chamber 13 for heated working medium is effectively in communication with a second storage chamber 16 for cooled working medium. When a storage chamber for heated working medium is empty, the storage chamber for cool working medium will be full, and vice versa. When the one storage chamber for heated working medium is empty, the other storage chamber for heated working medium will be full, and vice versa.

In the represented embodiments the above relations are realized by means of pistons as described below, which pistons are connected with a first gear rack 17 and a second gear rack 18. The pistons are moved by means of a driven gear wheel 19. The gear wheel can be driven directly by the shaft 10, optionally with or without an intermediate gear box, or indirectly by a motor. The power required for moving the working medium can be kept to a limit if, in accordance with a very favourable embodiment (and as shown in FIGS. 1 and 2) the absolute change in volume in the storage chamber 12 by means of a piston motion is equal to the absolute change in volume of the storage chamber 15. This also holds true for the storage chambers 13 and 16. In embodiments where a piston in a storage chamber is driven by a piston rod passing the wall of the storage chamber, the complementary storage chamber should also comprise a piston rod passing the wall of the storage chamber.

During operation the working medium in the part 1 to be heated, expands. This causes a pressure build-up in part 1. Working medium can leave part 1 via connection 20 between part 1 and part 2, which connection 20 comprises the hydromotor 9. In the embodiment represented, the connection is located between the cold ends of parts 1 and 2, but it may equally well connect the heated ends of the parts 1 and 2 to each other.

If part 1 were not provided with cold working medium from the first storage chamber 15 for cold working medium, the working medium present in part 1 to be heated would heat up completely and as a consequence the flow of working medium and therefore the production of mechanical energy would cease. Said cold working medium is supplied by means of moving a first piston 21 and a second piston 22, which in the represented embodiment are connected via gear rack 17 in such a manner that the first storage chamber 12 for heated working medium is filled and the second storage chamber 15 for cold working medium is emptied.

After emptying the second storage chamber for cold working medium, the first and second switch valves 11, 14 are put into the second position (FIG. 2). This allows heated working medium to flow from the filled first storage chamber 12 to the cold part 2, and to contract. This promotes the transport of working medium from the heated part 1 via connection 20. Therefore the direction of flow in the connection 20 remains the same. With the apparatus described, the amount of working medium flowing over the hydromotor 9 is only as much as the increase in volume.

When shifting between the first and second position of the switch valves 11, 14, the storage chambers which were initially under high pressure, undergo a sudden drop in pressure. To avoid damage to the apparatus, several measures are possible. For example, the pistons 21 and 22 may be stopped, or even be moved in the other direction, which would stop the heat exchange. As there is still paraffine flowing via the connection 20, the pressure is levelled out and the switch valves 11, 14 can be put in the other position. If desired, it is also possible to stop the supply of cooling medium and the heat source.

On starting up the apparatus, when all the working medium is cold and therefore contracted, part of the working medium expands. To prevent that this causes damage to the apparatus, expansion vessels 23, 24 are provided. These serve also as buffers for the absorption of pressure waves during shifting of the switch valves 11, 14.

An advantage of the apparatus descried is that during operation, the parts of the apparatus stay substantially at the same temperature.

In the method according to the invention the operational pressures are very high, generally between 100 and 1000 bars. As the output is greater at higher pressures, the pressure in the first part is advantageously higher than 250 bars. The pressure in the second part is, for example, 50 bars. The apparatus is adapted to the use of such pressures by employing round, that is to say cylindrical pipes and storage chambers. To insure good heat transfer, advantageous use is made of copper and copper alloys. High-pressure load capacity copper pipes as marketed by Wieland (Ulm, Germany), with a length of 35 m, a wall thickness of 1 mm and in inside diameter of 8 mm, are convenient to use.

The heat flow are relatively great in relation to the amount of heat converted into mechanical energy. For an efficient conversion of heat into mechanical energy, there must be an effective heat recovery. According to an advantageous embodiment this can be achieved by designing the part 1 to be heated as a spiral shaped tube and preferably by using a manifold (shown in FIG. 4), a plurality of spiral shaped tubes 1*a,b,c,d,e,f,g* (FIG. 3*a,b*). The tubes 1 are spaced by means of spacers 25 wound spirally around the tubes. These also promote mixing of the liquid (indicated by dashed-line arrow) moving around the tubes 1, which liquid is in counter current to the working medium (solid arrow). The whole, formed of tubes 1 plus spacers 25, is contained within a spiral shaped tube 26. The construction can be seen in FIG. 4, in which the part 1 to be heated surrounds the part 2 to be cooled in order to form a compact apparatus. By using a tubular heat exchanger, the choice of the length of the tubes simply depends on the desired extend of heat recovery. The expert is capable of choosing suitable operational conditions for carrying out the method, which conditions depend on the temperature of the heat source.

Depending on the temperature of the heated cooling medium, this is supplied to the part to be heated via one of the valves 27, 28, 29. The criterium being that the temperature of the cooling medium is substantially the same as or slightly higher than the temperature of the working medium at the point of supply.

The apparatus is controlled with the aid of the usual control and measuring equipment used in the art, as will be clear to the expert from the description. In particular measurements of pressure and temperature (P and T) are carried out, and the supply of heat via tube 8, the supply of cooling medium via tube 7, the shifting of switch valves 11, 14 and the movement of the pistons 21, 22 are controlled by means of a computer.

FIG. 5 shows that different paraffines exhibit different expansion behaviour and that therefore a paraffine may be used which in the working range, i.e. depending on the temperature of a particular heat source, exhibits maximum expansion (the melting point of the paraffine is indicated by ♦ in the Figure). A steep curve, i.e. a high expansion coefficient means that the surface area to be heated can be kept to a limit, which significantly lowers the size and the costs of the apparatus and is favourable for the conversion efficiency. The curves represented in FIG. 5 are for I Type 4444 with C18 paraffine (volume ratio 66:34), II Type 4444, III Type VP858, IV Type 5600. It is possible to influence the expansion coefficient and the melting point of a paraffine by adding other paraffines and solvents (compare curve II and I). A suitable working medium could consist of the following four components, C18–C20, Type 2139, C14–C17 (paraffines from Schüman-Sasol, Hamburg, Germany) and Petroleum Jellie Merkur 746 (B.R.B. Ittervoort, the Netherlands) in the volume ratios 70:20:5:5. For a mixture consisting of 75% C18–C20, 15% Type 2139 and 10% C10–C13 the operating temperature range is even lower (20–55° C.).

The invention is particularly suitable for the utilization of low-grade-heat sources, having, for instance, a temperature of approximately 60° C.

It will be clear to the expert that a variety of apparatuses can be used to carry out the method according to the invention. For instance, a single loop may be provided, with a first part, heated in counter current, being under high pressure, and its hot end being connected via a hydromotor with a second part, namely its hot end. In the second part the working medium is cooled in counter current and is pumped while cold, having a smaller volume, by means of a pump which may be driven directly or indirectly by the hydromotor, into the cold end of the first part. Cooling medium which is heated while cooling the second part, is used for counter-current heating of the first part.

It goes without saying that when designing an apparatus, the internal (flow) resistance of the working medium has to be taken into account. Said resistance must be limited as it affects the power that can be generated. The Molecular Friction Modifier, marketed by B.R.B. (Ittervoorde, the Netherlands) may conveniently be used. In contrast with particulate lubricants, lumping and accumulation are practically impossible with such molecular lubricants.

There are various possibilities for limiting the resistance in the exemplified apparatus. The pistons 21 and 22 employed in the embodiment represented in FIG. 1 require an excellent seal, which increases the friction. As an alternative the storage chambers 12 and 16 may be interconnected, and may, for instance be designed as a tube of poor heat conduction into which a movable body is introduced. This situation does not involve a great pressure difference, therefore the movable body to seal against the inside wall of the tube requires much less force, so that friction is limited. Instead of driving the movable body through the wall of the apparatus, a motor may be provided inside the apparatus, for instance, in storage chamber 15, for moving the movable body. Transport may be achieved by means of a screw extending through the movable body into the other storage chamber. The generator 10 also may be located inside the apparatus. In that case there are no movable parts at all moving through the wall of the apparatus, reducing leakage and friction problems to a minimum.

The method and apparatus according to the invention are suitable for the utilization of low-grade heat (waste) heat, such as from geothermical sources. A further possible application is micro-total energy central heating systems and solar collectors, optionally in combination with heat storage. In these cases it is not necessary to completely utilize the heat from the heat source, as this heat will later be used for space heating anyway, or will as medium requiring little additional heating, be led through the solar collector. The apparatus may also be useful in the development of hybrid engines for means of transport such as cars. Since the method and apparatus according to the present invention are able to very efficiently convert heat into mechanical energy, in particular into electricity, a heat pump may be used for abstracting heat from water or air, producing a heated flow whose temperature is sufficiently high to allow application of the invention.

What is claimed is:

1. A method for the conversion of thermal energy into mechanical energy in an apparatus comprising a first part in which a liquid working medium is heated using a heat source in the form of a liquid medium causing it to expand and a second part in which the working medium is cooled causing it to contract, wherein the first and the second part are effectively connected forming a closed circulation system containing the working medium, whereby as a result of heating, the working medium contained in the closed circulation system expands in the first part without phase change from liquid to gas, the working medium produces mechanical energy, the heated working medium is subjected to a heat exchange process for the recovery of thermal energy, which thermal energy is further utilized to do work, the liquid is in at least the second part in a counter-current heat-exchanging relationship and the transferred heat is used for the production of mechanical energy, characterized in that the liquid heat source medium is in a counter-current heat exchanging relationship with the liquid working medium in the first part to transfer substantially the entire heat content from the liquid heat source medium to the working medium in the first part.

2. A method according to claim 1, characterized in that the liquid is conducted into the second part in counter-current to a cooling medium, yielding heated cooling medium, and the heat of the thus heated cooling medium is conducted in counter-current with the working medium into the first part for the production of mechanical energy.

3. A method according to claim 1, characterized in that the liquid used is a liquid whose expansion coefficient in a working range is at least 0.02%/°C.

4. A method according to claim 3, characterized in that the working range lies between 15° C. and 100° C.

5. A method according to claim 2, characterized in that the liquid used is a paraffine-comprising liquid.

6. A method according to claim 5, characterized in that as the paraffine-comprising liquid a liquid is employed, which comprises an additive capable of lowering the internal resistance.

7. A method according to claim 5, characterized in that to reduce the internal resistance, 1–4% of a molecular lubricant, teflon or molybdenum sulphide is added.

8. A method according to claim 5, characterized in that as the paraffin-comprising liquid, a paraffinic liquid is added which has a working range that has been shifted to a lower temperature through dilution.

9. A method according to claim 1, characterized in that the working medium, in the part to be heated, is heated in counter-current with a heat source.

10. An apparatus suitable for the conversion of thermal energy into mechanical energy according to a method in accordance with claim 1, which apparatus comprises a part to be heated and a part to be cooled, which parts form a closed circulation system for the working medium, wherein during operation the working medium is able to flow from the part to be heated to the part to be cooled, and the apparatus is further provided with a shaft to be driven by the working medium and a heat exchanger for the recovery of thermal energy that has not been converted into mechanical energy, wherein the part to be heated has a first inlet opening for cold working medium and a first outlet opening for heated working medium, the part to be cooled has a second inlet opening for heated working medium and a second outlet opening for cold working medium, via a first switch valve in a first position the first outlet opening is in communication with a first storage chamber for heated working medium and in a second position with a second storage chamber for heated working medium, and the second inlet opening is in the second position in communication with the first storage chamber for heated working medium and in the first position with the second storage chamber for heated working medium, via a second switch valve in a first position the first inlet opening is in communication with a first storage chamber for cold working medium and in a second position with a second storage chamber for cold working medium and the second outlet opening is in the second position in communication with the first storage chamber for cold working medium and in the first position with the second storage chamber for cold working medium, the first storage chamber for heated working medium is effectively in communication with a first storage chamber for cold working medium such that when during operation the first storage chamber for heated working medium is filled to a maximum, the first storage chamber for cold working medium will be filled to a minimum, and vice versa, the second storage chamber for heated working medium is effectively in communication with a second storage chamber for cold working medium such that when during operation the second storage chamber for heated working medium is filled to a maximum, the second storage chamber for cold working medium will be filled to a minimum, and vice versa, during operation the first storage chamber for heated working medium is filled to a maximum when during operation the second storage chamber for heated working medium is filled to a minimum, and means are provided for taking a stage in which the first storage chamber for heated working medium and the second storage chamber for cold working medium are filled to a maximum, to a stage in which these are filled to a minimum and vice versa, the part to be heated is in communication with the part to be cooled via a device which is driven by means of the flow of the working medium, which device comprises the shaft.

11. An apparatus according to claim 10, characterized in that the first storage chamber for heated working medium and the first storage chamber for cold working medium, respectively the second storage chamber for heated working medium and the second storage chamber for cold working medium are provided with pistons.

12. An apparatus according to claim 11, characterized in that it is provided with means for keeping a side of the piston that is not facing the storage chamber under elevated pressure while the apparatus is in operation, which means are preferably suitable for maintaining a pressure which is equally high as the pressure prevailing in the part, and the means are thermically insulating means.

13. An apparatus according to claim 11, characterized in that the absolute change in volume in the storage chamber for heated working medium caused by a piston motion is equal to the absolute change in volume of the storage chamber for cold working medium.

* * * * *